US012662647B2

(12) United States Patent
Liu et al.

(10) Patent No.: US 12,662,647 B2
(45) Date of Patent: Jun. 23, 2026

(54) USE OF MOLYBDENUM COMPOUNDS IN DRIVELINE LUBRICANTS FOR REDUCED FRICTION AND COPPER CORROSION

(71) Applicant: Afton Chemical Corporation, Richmond, VA (US)

(72) Inventors: Kun Liu, Richmond, VA (US); Yungwan Kwak, Glen Allen, VA (US); Joseph Remias, Glen Allen, VA (US)

(73) Assignee: Afton Chemical Corporation

( * ) Notice: Subject to any disclaimer, the term of this patent is extended or adjusted under 35 U.S.C. 154(b) by 0 days.

(21) Appl. No.: 18/813,751

(22) Filed: Aug. 23, 2024

(65) Prior Publication Data

US 2026/0055333 A1 Feb. 26, 2026

(51) Int. Cl.

| | |
|---|---|
| ***C10M 169/04*** | (2006.01) |
| ***C10M 137/10*** | (2006.01) |
| ***C10M 139/00*** | (2006.01) |
| ***C10M 141/12*** | (2006.01) |
| *C10N 30/00* | (2006.01) |
| *C10N 30/06* | (2006.01) |
| *C10N 30/12* | (2006.01) |
| *C10N 40/04* | (2006.01) |

(52) U.S. Cl.

CPC ..... *C10M 169/04* (2013.01); *C10M 137/105* (2013.01); *C10M 139/00* (2013.01); *C10M 141/12* (2013.01); *C10M 2203/003* (2013.01); *C10M 2223/047* (2013.01); *C10M 2227/09* (2013.01); *C10N 2030/06* (2013.01); *C10N 2030/12* (2013.01); *C10N 2030/43* (2020.05); *C10N 2030/45* (2020.05); *C10N 2040/04* (2013.01)

(58) Field of Classification Search

CPC ..... C10M 169/04; C10M 137/105; C10M 139/00; C10M 141/12; C10M 2203/003; C10M 2223/047; C10M 2227/09; C10N 2030/06; C10N 2030/12; C10N 2030/43; C10N 2030/45; C10N 2040/04

See application file for complete search history.

(56) References Cited

U.S. PATENT DOCUMENTS

| | | | |
|---|---|---|---|
| 2,237,625 | A | 4/1941 | Olin |
| 2,237,627 | A | 4/1941 | Olin |
| 2,527,948 | A | 10/1950 | Lyon et al. |
| 2,695,316 | A | 11/1954 | Mcbride |
| 2,995,569 | A | 8/1961 | Hamilton et al. |
| 3,022,351 | A | 2/1962 | Mihm et al. |
| 3,219,666 | A | 11/1965 | Norman et al. |
| 3,308,166 | A | 3/1967 | Michel et al. |
| 3,392,201 | A | 7/1968 | Warner |
| 3,471,404 | A | 10/1969 | Herbert |
| 3,502,677 | A | 3/1970 | Sner |
| 3,565,804 | A | 2/1971 | Honnen et al. |
| 3,634,515 | A | 1/1972 | Karll et al. |
| 3,673,090 | A | 6/1972 | Waldbillig et al. |
| 3,697,429 | A | 10/1972 | Smith et al. |
| 3,697,574 | A | 10/1972 | Piasek et al. |
| 3,703,504 | A | 11/1972 | Horodysky |
| 3,703,505 | A | 11/1972 | Jaggers et al. |
| 3,736,357 | A | 5/1973 | Karll et al. |
| 3,763,244 | A | 10/1973 | Shubkin |
| 3,796,661 | A | 3/1974 | Allen et al. |
| 3,816,346 | A | 6/1974 | Coppock et al. |
| 3,873,454 | A | 3/1975 | Horodysky et al. |
| 3,991,056 | A | 11/1976 | Okamoto et al. |
| 4,036,771 | A | 7/1977 | Denis et al. |
| 4,118,329 | A | 10/1978 | Hotten |
| 4,119,549 | A | 10/1978 | Davis |
| 4,119,550 | A | 10/1978 | Davis et al. |
| 4,147,640 | A | 4/1979 | Jayne et al. |
| 4,191,659 | A | 3/1980 | Davis |
| 4,204,969 | A | 5/1980 | Papay et al. |
| 4,209,471 | A | 6/1980 | Dube et al. |
| 4,218,332 | A | 8/1980 | Schwab et al. |
| 4,234,435 | A | 11/1980 | Meinhardt et al. |
| 4,240,958 | A | 12/1980 | Braid |
| 4,282,392 | A | 8/1981 | Cupples et al. |
| 4,285,822 | A | 8/1981 | deVries et al. |
| 4,344,854 | A | 8/1982 | Davis et al. |
| 4,472,306 | A | 9/1984 | Powers, III et al. |
| 4,537,696 | A | 8/1985 | Beimesch |
| 4,564,709 | A | 1/1986 | Koyama et al. |
| 4,587,368 | A | 5/1986 | Pratt |
| 4,636,322 | A | 1/1987 | Nalesnik |
| 4,711,736 | A | 12/1987 | Horodysky et al. |
| 4,747,971 | A | 5/1988 | Erdman |

(Continued)

FOREIGN PATENT DOCUMENTS

| | | | |
|---|---|---|---|
| CN | 107760413 | A | 3/2018 |
| EP | 0088453 | A1 | 9/1983 |

(Continued)

OTHER PUBLICATIONS

International Search Report and Written Opinion for PCT Application PCT/IB2021/062427, Apr. 7, 2022.

Takeuchi et al. "Investigation of engine oil effect on abnormal combustion in turbocharged direct injection—spark injection engines" SAE Int. Nov. 2012, v 5, issue 3 (abstract).

Haenel et al. "Systematic approach to analyze and characterize pre-ignition events in turbocharged direct-injected gasoline engines" SAE Int. Apr. 2011 (abstract).

W.W. Yau et al. "Modern size exclusion liquid chromatography" John Wiley and Sons, New York, 1979.

Extended European Search Report for EP 25194186.0, dated Jan. 15, 2026.

*Primary Examiner* — Cephia D Toomer

(74) *Attorney, Agent, or Firm* — Honigman LLP

(57) ABSTRACT

A driveline lubricating composition for electric or hybrid-electric motor systems including a phosphorus antiwear additive and a multi-functional oil-soluble organolmolybdenum friction modifier to provide friction modification and low copper leaching.

16 Claims, No Drawings

(56) References Cited

U.S. PATENT DOCUMENTS 4,795,576 A 1/1989 Born et al.
4,857,214 A 8/1989 Papay et al.
4,859,352 A 8/1989 Waynick
4,925,983 A 5/1990 Steckel
4,941,984 A 7/1990 Chamberlin, III et al.
4,954,274 A 9/1990 Zaweski et al.
4,956,122 A 9/1990 Watts et al.
4,966,720 A 10/1990 DeGonia et al.
4,992,183 A 2/1991 Beimesch et al.
5,089,156 A 2/1992 Chrisope et al.
5,114,602 A 5/1992 Petrille et al.
5,137,647 A 8/1992 Karol
5,266,223 A 11/1993 Song et al.
5,364,545 A 11/1994 Arai et al.
5,614,480 A 3/1997 Salomon et al.
5,627,259 A 5/1997 Thaler et al.
5,633,326 A 5/1997 Patil et al.
5,643,859 A 7/1997 Gutierrez et al.
5,792,729 A 8/1998 Harrison et al.
5,851,965 A 12/1998 Harrison et al.
5,853,434 A 12/1998 Harrison et al.
5,936,041 A 8/1999 Diana et al.
6,124,247 A 9/2000 Cazin et al.
6,303,546 B1 10/2001 Hata et al.
6,586,374 B1 7/2003 Paul
6,667,281 B2 12/2003 Ikejima et al.
6,808,241 B2 10/2004 MacKenzie et al.
6,903,056 B2 6/2005 Nagano et al.
8,143,202 B2 3/2012 Peer et al.
8,260,530 B2 9/2012 Rollinger et al.
8,327,687 B2 12/2012 Amann et al.
8,400,030 B1 3/2013 Tang et al.
8,543,315 B2 9/2013 Glugla et al.
8,563,486 B2 10/2013 Tsujimoto et al.
8,664,169 B2 3/2014 Bouffet
8,901,052 B2 12/2014 Sagawa et al.
8,999,904 B2 4/2015 Matsui et al.
9,481,696 B1 11/2016 Edwards et al.
9,522,972 B2 12/2016 Visger et al.
9,550,952 B2 1/2017 Patel et al.
9,574,156 B2 2/2017 Tang et al.
9,598,658 B2 3/2017 Scanlon et al.
9,896,634 B2 2/2018 Gao et al.
9,944,877 B2 4/2018 Gao et al.
10,829,713 B2 11/2020 Abraham et al.
11,034,912 B2 6/2021 Ritchie et al.
11,214,750 B2 1/2022 Milner
11,326,123 B1 5/2022 Adhvaryu et al.
11,479,735 B2 10/2022 Iyer et al.
11,939,551 B1 3/2024 Iyer et al.
12,043,817 B1 7/2024 Hurley
2002/0151441 A1 10/2002 Srinivasan et al.
2002/0151443 A1 10/2002 Srinivasan
2002/0165102 A1 11/2002 Hata et al.
2003/0153469 A1 8/2003 Ozbalik
2004/0242434 A1 12/2004 Yagishita et al.
2005/0101496 A1 5/2005 Loper et al.
2006/0058200 A1 3/2006 Shaw et al.
2006/0217271 A1 9/2006 Brown et al.
2007/0037715 A1 2/2007 Okada
2007/0184992 A1 8/2007 Takeuchi et al.
2008/0128184 A1 6/2008 Loper et al.
2008/0194442 A1 8/2008 Watts et al.
2008/0302422 A1 12/2008 Neveu et al.
2009/0156446 A1 6/2009 McAtee et al.
2010/0130390 A1 5/2010 Tipton et al.
2011/0111997 A1 5/2011 Cook et al.
2011/0213538 A1 9/2011 Amann et al.
2011/0265761 A1 11/2011 Amann et al.
2012/0029789 A1 2/2012 Mehta et al.
2012/0101017 A1 4/2012 Duggal
2012/0186225 A1 7/2012 Amann et al.
2012/0208731 A1 8/2012 Lann et al.
2012/0283159 A1 11/2012 Matsui et al.
2013/0035841 A1 2/2013 Glugla et al.
2013/0096041 A1* 4/2013 Matray ..... C10M 141/10 508/272
2013/0225461 A1 8/2013 Barton et al.
2014/0162919 A1 6/2014 Fu et al.
2014/0249061 A1 9/2014 Youn et al.
2014/0296118 A1 10/2014 Costello et al.
2015/0038385 A1 2/2015 Barton et al.
2015/0322322 A1 11/2015 Sondjaja et al.
2015/0322367 A1 11/2015 Patel et al.
2015/0322369 A1 11/2015 Patel et al.
2016/0024416 A1 1/2016 Kamano
2016/0108337 A1 4/2016 Abraham et al.
2016/0230116 A1 8/2016 Mosier et al.
2016/0281020 A1 9/2016 Yamamoto et al.
2017/0015926 A1 1/2017 Fletcher et al.
2017/0015929 A1* 1/2017 Fletcher ..... C10M 169/04
2017/0015930 A1 1/2017 Fletcher et al.
2017/0022441 A1 1/2017 Onodera et al.
2017/0130161 A1 5/2017 Vettel et al.
2017/0306259 A1 10/2017 Ding et al.
2018/0002631 A1 1/2018 Milner
2018/0072962 A1 3/2018 Wada et al.
2018/0079990 A1 3/2018 Aoyama
2018/0100114 A1 4/2018 Gao et al.
2018/0100115 A1* 4/2018 Gao ..... C10M 135/18
2018/0100117 A1 4/2018 Flores-Torres et al.
2018/0100118 A1 4/2018 Flores-Torres et al.
2018/0100119 A1 4/2018 Aoyama
2018/0134983 A1 5/2018 Broutin et al.
2018/0327687 A1 11/2018 Kwak
2019/0002785 A1 1/2019 Sanson et al.
2019/0002790 A1 1/2019 Sanson et al.
2019/0078034 A1 3/2019 Saccomando et al.
2019/0112541 A1 4/2019 Hamachi
2019/0284495 A1 9/2019 Abraham et al.
2019/0367830 A1 12/2019 Iwai
2020/0172826 A1* 6/2020 Balasubramaniam ..... C10M 169/044
2020/0248095 A1 8/2020 Guerin
2020/0277542 A1 9/2020 Salvi et al.
2021/0009920 A1 1/2021 Kwak
2021/0371767 A1 12/2021 Shimizu et al.

FOREIGN PATENT DOCUMENTS

EP 0612839 A1 8/1994
EP 1040115 B1 6/2004
EP 1788068 A1 5/2007
EP 2639433 A1 9/2013
EP 3872151 A1 9/2021
EP 4317370 A1 2/2024
FR 3097873 A1 1/2021
GB 961009 A 6/1964
GB 1162334 A 8/1969
JP 2014152301 A 8/2014
JP 2016534216 A 11/2016
JP 2017514984 A 6/2017
JP 2017149830 A 8/2017
JP 201821107 A 2/2018
JP 2018168344 A 11/2018
WO 2009104682 A1 8/2009
WO 2014186318 11/2014
WO 2015023559 A1 2/2015
WO 2015042337 A1 3/2015
WO 2015042340 A1 3/2015
WO 2015042341 A1 3/2015
WO 2015076417 A1 5/2015
WO 20150114920 A1 8/2015
WO 2017011691 A1 1/2017
WO 2017189277 A1 11/2017
WO 2017210388 A1 12/2017
WO 2020085228 A1 4/2020

* cited by examiner

USE OF MOLYBDENUM COMPOUNDS IN DRIVELINE LUBRICANTS FOR REDUCED FRICTION AND COPPER CORROSION

TECHNICAL FIELD

The present disclosure relates to a lubricating fluid for a driveline of an electric motor system and a method of lubricating the driveline. In particular, the disclosed methods and lubricating fluids relate to a lubricating fluid including an oil of lubricating viscosity and a multi-functional organomolybdenum complex of organic esters and/or amides.

BACKGROUND

A major challenge in developing electric and hybrid-electric vehicle driveline and powertrain lubricants is achieving acceptable friction performance with material compatibility of components in the electric motor systems. Lubricants for electric and hybrid-electric vehicles, therefore, confront issues not found in lubricants for non-electrified vehicles. For instance, to achieve good friction performance, lubricants often include a friction modifier to reduce metal-to-metal friction. Many friction modifiers, however, tend to negatively impact copper corrosion (e.g., through copper leaching and/or copper tarnishing) that can be detrimental to the electric components of various electric and/or hybrid-electric vehicle drivelines or powertrains. Because the lubricant of an electric motor system also contacts electrical components in the motor and/or driveline, formulating lubricants with acceptable friction performance and low copper corrosion performance tends to be challenging in view of the dilemma that conventional friction modifiers, while providing low friction, unfortunately tend to provide poor copper corrosion that is undesired in electric motor systems.

SUMMARY

In one embodiment, a driveline lubricating composition for electric or hybrid-electric vehicles is disclosed herein. In aspects of this embodiment, the driveline lubricating composition includes one or more base oils of lubricating viscosity; a multi-functional oil-soluble organomolybdenum friction modifier and corrosion inhibitor having one or more ester and/or amide moieties and having about 1 to about 15 weight percent molybdenum; a phosphorus antiwear additive providing about 100 ppm or less phosphorus to the driveline lubricating composition; and wherein the driveline lubricating composition has less than about 300 ppm of total sulfur.

In other approaches or embodiments, the driveline lubricating composition of the previous paragraph include other features or embodiments in any combination. These other features or embodiments include one or more of the following: wherein the phosphorus antiwear additive includes an ashless dialkyl dithiophosphate providing about 100 ppm or less phosphorus and about 150 ppm or less sulfur to the driveline lubricating composition; and/or wherein the ashless dialkyl dithiophosphate is made by a process comprising the steps of reacting an organic hydroxy compound with phosphorus pentasulfide to form a reaction product and further reacting the reaction product with an unsaturated carboxylic acid to form the oil-soluble phosphorus antiwear additive including the ashless dialkyl Dithiophosphate; and/or wherein the ashless dialkyl dithiophosphate includes a compound of Formula V, or a salt thereof:

(Formula V)

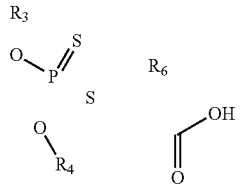

wherein $R_3$ and $R_4$ are, independently, a $C_3$ to $C_8$ linear or branched alkyl group, and $R_6$ is —H or —$CH_3$; and/or wherein the multi-functional oil-soluble organomolybdenum friction modifier and corrosion inhibitor provides about 20 to about 500 ppm molybdenum; and/or wherein the multi-functional oil-soluble organomolybdenum friction modifier and corrosion inhibitor having ester and/or amide ligands is substantially free of sulfur and/or phosphorus; and/or wherein the multi-functional oil-soluble organomolybdenum friction modifier and corrosion inhibitor having ester and/or amide ligands is derived from a fatty derivative of a dialkanolamine and a source of molybdenum; and/or wherein the fatty derivative of the dialkanolamine is a fatty derivative of diethanolamine and the source of molybdenum is an oxygen-containing molybdenum compound; and/or wherein the oxygen-containing molybdenum compound is selected from an ammonium molybdate, a molybdenum oxide, or mixtures thereof; and/or wherein the multi-functional oil-soluble organomolybdenum friction modifier and corrosion inhibitor having one or more ester and/or amide moieties is the reaction product of about 1 mol of a fatty oil or fatty acid having 12 or more carbon atoms, about 1 to about 2.5 mols of diethanolamine, and an oxygen-containing molybdenum compound in amounts sufficient to produce a reaction product having about 1 to about 15 weight percent of molybdenum based on the weight of reaction product; and/or wherein a weight ratio of total sulfur and total phosphorus relative to total molybdenum (S+P)/Mo is about 0.7 to about 10.0; and/or wherein the driveline lubricating composition is substantially free of separate corrosion inhibitors and/or substantially free of separate friction modifiers; and/or wherein the separate corrosion inhibitors include monocarboxylic acid and/or polycarbocylic acid corrosion inhibitors, alkenyl succinic acid, acid/ester, or anhydride corrosion inhibitors, ether amine corrosion inhibitors, imidazoline corrosion inhibitors, benzotriazole corrosion inhibitors, or combinations thereof; and/or wherein the driveline lubricating composition has less than 120 ppm of copper leaching when evaluated pursuant to ASTM D130 at about 150° C. after about 168 hours; and/or wherein the driveline lubricating composition has a friction coefficient, when measured using a high frequency reciprocating rig (HFRR), of less than 0.160 and when evaluated using a 400 gram load, a 20 Hz frequency, and using a composition temperature of 130° C. for 3 minutes.

In other approaches or embodiments, a method of lubricating a driveline of an electric or hybrid-electric vehicle is provided herein. In aspects of this approach or embodiment, the method includes lubricating the driveline of the electric or hybrid-electric vehicle with a lubricating composition; and wherein the lubricating composition includes (i) one or more base oils of lubricating viscosity; (ii) a phosphorus antiwear additive providing about 100 ppm or less phosphorus to the driveline lubricating composition; (iii) a multi-functional oil-soluble organomolybdenum friction modifier and corrosion inhibitor having one or more ester and/or amide moieties and having about 1 to about 15 weight percent molybdenum; and wherein the driveline lubricating composition has less than about 300 ppm of total sulfur.

In yet other approaches or embodiments, the method described in the previous paragraph may include other features, embodiments, or method steps in any combination. These other features, embodiments, or method steps including one or more of the following: wherein the phosphorus antiwear additive includes an ashless dialkyl dithiophosphate antiwear additive providing about 100 ppm or less phosphorus and about 150 ppm or less sulfur to the driveline lubricating composition; and/or wherein the ashless dialkyl dithiophosphate is made by a process comprising the steps of reacting an organic hydroxy compound with phosphorus pentasulfide to form a reaction product and further reacting the reaction product with an unsaturated carboxylic acid to form the oil-soluble phosphorus antiwear additive including the ashless dialkyl Dithiophosphate; and/or wherein the ashless dialkyl dithiophosphate includes a compound of Formula V, or a salt thereof:

(Formula V)

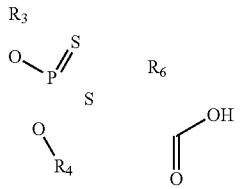

wherein $R_3$ and $R_4$ are, independently, a $C_3$ to $C_8$ linear or branched alkyl group, and $R_6$ is —H or —$CH_3$; and/or wherein the multi-functional oil-soluble organomolybdenum friction modifier and corrosion inhibitor provides about 20 to about 500 ppm molybdenum; and/or wherein the multi-functional oil-soluble organomolybdenum friction modifier and corrosion inhibitor having ester and/or amide ligands is substantially free of sulfur and/or phosphorus; and/or wherein the multi-functional oil-soluble organomolybdenum friction modifier and corrosion inhibitor having ester and/or amide ligands is substantially free of sulfur and/or phosphorus; and/or wherein the multi-functional oil-soluble organomolybdenum friction modifier and corrosion inhibitor having ester and/or amide ligands is derived from a fatty derivative of a dialkanolamine and a molybdenum source; and/or wherein the fatty derivative of the dialkanolamine is a fatty derivative of diethanolamine and the molybdenum source is an oxygen-containing molybdenum compound; and/or wherein the oxygen-containing molybdenum compound is selected from an ammonium molybdate, a molybdenum oxide, or mixtures thereof; and/or wherein the multi-functional oil-soluble organomolybdenum friction modifier and corrosion inhibitor having one or more ester and/or amide moieties is the reaction product of about 1 mol of a fatty oil or fatty acid having 12 or more carbon atoms, about 1 to 2.5 mols of diethanolamine, and a source of molybdenum sufficient to yield about 1 to about 15 weight percent of molybdenum based on the weight of additive; and/or wherein a weight ratio of total sulfur and total phosphorus relative to total molybdenum (S+P)/Mo is about 0.7 to about 10.0; and/or wherein the driveline lubricating composition is substantially free of separate corrosion inhibitors and/or substantially free of separate friction modifiers; and/or wherein the separate corrosion inhibitors include monocarboxylic acid and/or polycarbocylic acid corrosion inhibitors, alkenyl succinic acid, acid/ester, or anhydride corrosion inhibitors, ether amine corrosion inhibitors, imidazoline corrosion inhibitors, benzotriazole corrosion inhibitors, or combinations thereof; and/or wherein the driveline lubricating composition has less than 120 ppm of copper leaching when evaluated pursuant to ASTM D130 at 150° C. after 168 hours; and/or wherein the driveline lubricating composition has a friction coefficient, when measured using a high frequency reciprocating rig (HFRR), of less than 0.160 and when evaluated using a 400 gram load, a 20 Hz frequency, and at a composition temperature of 130° C. for 3 minutes.

In yet other approaches or embodiments, the use of any embodiment of the multi-functional oil-soluble organomolybdenum friction modifier and corrosion inhibitor described in this Summary and/or the use of a lubricating composition including (i) one or more base oils of lubricating viscosity; (ii) a phosphorus antiwear additive providing about 100 ppm or less phosphorus to the driveline lubricating composition; (iii) a multi-functional oil-soluble organomolybdenum friction modifier and corrosion inhibitor having one or more ester and/or amide moieties and having about 1 to about 15 weight percent molybdenum; and wherein the driveline lubricating composition has less than about 300 ppm of total sulfur to achieve one or both of (i) less than 120 ppm of copper leaching when evaluated pursuant to ASTM D130 at 150° C. after 168 hours and/or (ii) wherein the driveline lubricating composition has a friction coefficient, when measured using a high frequency reciprocating rig (HFRR), of less than 0.160 and when evaluated using a 400 gram load, a 20 Hz frequency, and at a composition temperature of 130° C. for 3 minutes. Any embodiment of the methods or compositions as described in the summary may also be provided in the described use.

Other embodiments of the present disclosure will be apparent to those skilled in the art from consideration of the specification and practice of the invention disclosed herein.

DETAILED DESCRIPTION

According to exemplary embodiments, a driveline lubricating composition suitable for electric and/or hybrid-electric vehicles is described herein that achieves good friction performance and low copper corrosion by using a multi-functional organomolybdenum friction modifier. In one aspect, the organomolybdenum friction modifier is select oil-soluble organomolybdenum compounds or complexes having one or more ester and/or amide moieties configured to achieve, in a single additive, good friction performance and low copper corrosion. While some organomolybdenum compounds have been used as friction modifiers, it was not expected that certain oil-soluble organomolybdenum compounds and/or complexes thereof having the one or more ester and/or amide moieties would function both as a good friction modifier providing acceptable HFRR friction coefficients and, at the same time, also providing low copper leaching.

In one approach or embodiment, the driveline lubricating compositions herein suitable for lubricating a transmission, driveline, and/or powertrain of an electric or hybrid-electric vehicle include at least one or more base oils of lubricating viscosity; a multi-functional oil-soluble organomolybdenum friction modifier and corrosion inhibitor having one or more ester and/or amide moieties; a phosphorus antiwear additive providing about 100 ppm or less phosphorus; and wherein the driveline lubricating composition has less than about 300 ppm of total sulfur. In another approach or embodiment, the driveline lubricating compositions herein suitable for lubricating a transmission, driveline, and/or powertrain of an electric or hybrid-electric vehicle include one or more base oils of lubricating viscosity; a multi-functional oil-soluble organomolybdenum friction modifier and corrosion inhibitor having one or more ester and/or amide moieties; a phosphorus and sulfur antiwear additive in the form of an ashless dialkyl dithiophosphate antiwear additive providing, in some embodiments, about 100 ppm or less phosphorus and about 150 ppm or less sulfur to the driveline lubricating composition; and wherein the driveline lubricating composition has less than about 300 ppm of total sulfur. Each of the component additives is further described below.

Oil-Soluble Organomolybdenum Additive

The driveline lubricating compositions herein include a multi-functional oil-soluble organomolybdenum friction modifier and corrosion inhibitor additive having one or more ester and/or amide moieties. This additive is generally a mixture of one or more compounds and/or is a complex of oil-soluble molybdenum components and, in one embodiment, the reaction product of a fatty acid or fatty oil, a dialkanolamine, and a source of molybdenum to yield a reaction product mixture including one or more molybdenum compounds or complexes of compounds having the ester and/or amide moieties. Major components of the reaction product include one or more of the following compounds of Formula I, Formula II, and/or Formula III:

(Formula I)

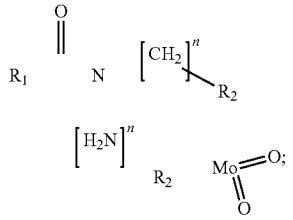

(Formula II)

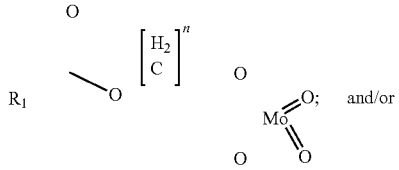

(Formula III)

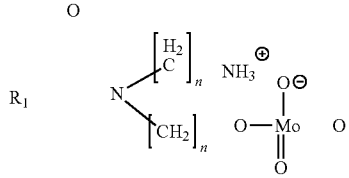

wherein $R_1$ of Formula I, II, and/or III is a C10 to C30 hydrocarbyl chain (or a C12 to C26 hydrocarbyl chain), each $R_2$ is, independently, an oxygen atom or a nitrogen atom, with at least one $R_2$ being an oxygen atom and, preferably, each $R_2$ being oxygen; and each n is, independently, an integer of 1 to 4, preferably 1 to 3, and most preferably 1 or 2. In one embodiment, $R_1$ is a C12 to C26 hydrocarbyl chain, each $R_2$ is an oxygen, and n is 1 or 2. As used herein, the oil-soluble organomolybdenum reaction product is a mixture of one or more compounds or a complex of compounds wherein a complex is generally understood as two or more components or compounds associated together with a loose arrangement of compounds that is generally weaker than a covalent bond.

In one embodiment, the oil-soluble organomolybdenum compound or complex is prepared by reacting a fatty acid or a fatty oil, a dialkanolamine (preferably, diethanolamine), and a source of molybdenum. In one approach, the organomolybdenum compound or complex is prepared by sequentially reacting the fatty acid or fatty oil with the diethanolamine to form a reaction intermediate, which is then reacted with the source of molybdenum. Reaction temperatures may be about 70° C. to about 160° C. Suitable fatty acids may be C12 to C30 fatty acids, and/or suitable fatty oils may be vegetable oils or animal oils including reaction product of the fatty acid/fatty oil and dialkanolamine to form the ester- and/or amide-including molybdenum compounds or complexes in the resulting reaction product. In one approach, the source of molybdenum includes, but is not limited to, ammonium molybdates, molybdenum oxides and/or mixtures thereof. In one approach, the oil-soluble organomolybdenum compound or complex is prepared by reacting about 1 mole of the fatty acid or fatty oil, about 1.0 to about 2.5 moles of the dialkanolamine (preferably, diethanolamine) and a sufficient amount of the source of molybdenum to form a reaction product or mixture including up to about 15 percent of molybdenum, in other approaches, up to about 12 weight percent molybdenum, or up to about 10 weight percent molybdenum.

In approaches or embodiments, the multi-functional oil-soluble compound or complex herein includes about 1 to about 15 percent molybdenum (or about 1 to about 12 weight percent, or about 6 to about 12 weight percent molybdenum), and in other embodiments, is substantially free of sulfur and/or substantially free of phosphorus. In this context, substantially free of sulfur and/or phosphorus means the reaction product herein has less than 10 ppm of sulfur and/or phosphorus, less than 5 ppm, less than 2 ppm, less than 1 ppm or no detectable levels of sulfur and/or phosphorus.

In approaches, the multi-functional oil-soluble organomolybdenum compound or complex is added to the lubricating oil compositions herein in amounts to provide about 20 to about 500 ppm of molybdenum to the lubricating oil compositions (in other approaches, about 30 to about 400 ppm of molybdenum, or about 30 to about 200 ppm molybdenum or about 100 ppm molybdenum to about 400 molybdenum, or about 150 to about 400 ppm molybdenum, or about 200 to about 400 ppm molybdenum).

As shown in the Examples below, when such amounts of the oil-soluble organomolybdenum compound or complex are included in the lubricating oil compositions, then the compositions achieve desired HFRR boundary friction coefficients and, at the same time, low copper leaching and, surprisingly, (in some embodiments) without the need for additional corrosion inhibitors and/or additional friction modifiers. In one embodiment, for example, the driveline lubricating compositions herein exhibit less than 120 ppm of copper leaching when evaluated pursuant to ASTM D130 at 150° C. after 168 hours (in other approaches, less than 100 ppm, less than 80 ppm, or less than 65 ppm of copper leaching), and/or the driveline lubricating compositions herein also exhibit a friction coefficient, when measured using a high frequency reciprocating rig (HFRR), of less than 0.160 and evaluated using a 400 gram load, a 20 Hz frequency, and at a composition temperature of 130° C. for 3 minutes (in other approaches, a friction coefficient of less than 0.150, less than 0.120, less than 0.100, or less than 0.080).

Such friction performance and corrosion resistance is achieved with the driveline lubricating compositions herein being substantially free of other traditional corrosion inhibitors and, in some embodiments, also being substantially free of other friction modifiers. In this context, substantially free of other traditional corrosion inhibitors and/or other friction modifiers means less than 0.5 weight percent, less than 0.1 weight percent, less than 0.05 weight percent, or no functional amounts of separate corrosion inhibitor additives and/or separate friction modifier additives. As used herein, the separate corrosion inhibitor additives include, but not limited to, monocarboxylic acid and/or polycarbocylic acid corrosion inhibitors, alkenyl succinic acid, acid/ester, or anhydride corrosion inhibitors, ether amine corrosion inhibitors, imidazoline corrosion inhibitors, tolyltriazole corrosion inhibitors, benzotriazole corrosion inhibitors, and/or combinations thereof. As used herein, other separate friction modifiers include, but not limited to, imidazolines, succinimides, alkoxylated amines, alkoxylated ether amines, amine oxides, nitriles, betaines, quaternary amines, imines, amine salts, amino guanidine, alkanolamides, phosphonates, glycerol esters, sulfurized fatty compounds and olefins, sunflower oil other naturally occurring plant or animal oils, dicarboxylic acid esters, esters or partial esters of a polyol, and one or more aliphatic or aromatic carboxylic acids, and the like.

Phosphorus Antiwear Additive

In one embodiment, the driveline lubricating compositions herein include a phosphorus antiwear additive providing about 100 ppm or less phosphorus (in other approaches, about 40 ppm to 100 ppm phosphorus or about 50 ppm to about 80 ppm phosphorus to the lubricating oil compositions). Examples of suitable phosphorus antiwear additives include, but are not limited to, metal thiophosphates; metal dialkyldithiophosphates; phosphoric acid esters or salts thereof; phosphate esters; phosphites; phosphorus-containing carboxylic esters, ethers, or amides; and/or mixtures thereof. The metal in any dialkyldithio phosphate salts herein may be an alkali metal, alkaline earth metal, aluminum, lead, tin, molybdenum, manganese, nickel, copper, titanium, and/or zinc. Suitable phosphorus acids include phosphoric, phosphonic, phosphinic, and/or thiophosphoric acids, including dithiophosphoric acid as well as the monothiophosphoric acid, thiophosphinic, and thiophosphonic acids.

In one embodiment, the phosphorus antiwear additive is a phosphorus acid ester prepared by reacting one or more phosphorus acid or anhydride with an alcohol containing from 1, or up to about 3, carbon atoms. The alcohol generally contains up to about 30, preferably up to about 24, more preferably up to about 12, carbon atoms. The phosphorus acid or anhydride is generally an inorganic phosphorus reagent, such as phosphorus pentoxide, phosphorus trioxide, phosphorus tetroxide, phosphorus acid, phosphorus halide, lower phosphorus esters, or a phosphorus sulfide and the like. The phosphates may be di- or tri-hydrocarbyl phosphates. Generally the phosphates are di- or tri-alkyl or aryl phosphates. The hydrocarbyl group generally contains from about 6 to about 24, preferably about 6 to about 18, carbon atoms. When the hydrocarbyl group is an aryl group, then the group contains at least about six carbon atoms. In one embodiment, the phosphate is a di- or tri-aryl phosphate having about six to about eight carbon atoms in each aryl groups. Examples of phosphates include tricresol phosphate (TCP), triphenyl phosphate, trioctyl phosphate, trilauryl phosphate, tristearyl phosphate, trioleyl phosphate, and the like.

Suitable phosphites may be dialkyl or trialkyl phosphite, preferably a dialkyl phosphite. The alkyl phosphonate may be an alkyl phosphonate diester, preferably a dialkylester. The alkyl groups of the phosphite and the phosphonate independently contain from 1, or about 3 to about 24, or to about 18, or to about 8 carbon atoms. In one embodiment, the phosphite and the phosphonic acid ester have alkyl groups independently containing from about 3 to about 6, or to about 5, carbon atoms. Exemplary dialkyl phosphites include dimethyl, diethyl, dipropyl, dibutyl, dipentyl, and dihexyl phosphites. Also mixed alkyl phosphites, made from a mixture of alcohols, may be used as the phosphorus antiwear additive. Examples of mixtures of alcohols include ethyl and butyl alcohol, propyl and pentyl alcohol, and methyl and pentyl alcohol.

Alkyl phosphonates may also be used as the phosphorus antiwear additive. Suitable alkyl phosphonates may be prepared by reacting an alkyl halide with a trialkyl phosphite. Examples of alkyl phosphonates include diethyl, butyl phosphonate; dibutyl, butyl phosphonate; 2-ethylhexyl, 2-ethylhexyl phosphonate, and the like.

The phosphorus antiwear additive may also be a thiophosphorus ester or salt thereof. Thiophosphorus acid esters may be prepared by reacting a phosphorus sulfide with an alcohol. The thiophosphorus acid esters may be mono- or dithiophosphorus acid esters. Thiophosphorus acid esters are also referred to generally as thiophosphoric acids.

The phosphorus acid ester may be a monothiophosphoric acid ester or a monothiophosphate. In one embodiment, monothiophosphates are prepared by the reaction of a sulfur source with a dihydrocarbyl phosphite. The sulfur source may for instance be elemental sulfur. The sulfur source may also be a monosulfide, such as a sulfur coupled olefin or a sulfur coupled dithiophosphate. Elemental sulfur is a preferred sulfur source.

The phosphorus antiwear additive may also be a dithiophosphoric acid or phosphorodithioic acid. The dithiophosphoric acid may be represented by the formula $(RO)_2PSSH$ wherein each R is independently a hydrocarbyl group containing from 3 to about 30 carbon atoms. R generally contains up to about 18, or to about 12, or to about 8 carbon atoms. Exemplary R groups include, but are not limited to, isopropyl, isobutyl, n-butyl, sec-butyl, the various amyl, n-hexyl, methylisobutyl carbinyl, heptyl, 2-ethylhexyl, isooctyl, nonyl, behenyl, decyl, dodecyl, and tridecyl groups. Exemplary alkylphenyl R groups include butylphenyl, amylphenyl, heptylphenyl, and the like groups. Examples of mixtures of R groups include, but are not limited to, 1-butanol and 1-octanol; 1-pentanol and 2-ethyl-1-hexanol; isobutanol and 1-hexanol; isobutyl alcohol and isoamyl alcohol; 2-propanol and 2-methyl-4-pentanol; isopropyl alcohol and sec-butyl alcohol; and isopropyl alcohol and isooctyl alcohol.

The phosphorus antiwear additive may also be a metal thiophosphate, preferably a metal dithiophosphate. Examples of metal dithiophosphates include zinc isopropyl, methyl amyl dithiophosphate, zinc isopropyl isooctyl dithiophosphate, barium di(nonyl)-dithiophosphate, zinc di(cyclohexyl) dithiophosphate, zinc di(isobutyl) dithiophosphate, calcium di(hexyl) dithiophosphate, zinc isobutyl isoamyl dithiophosphate, and zinc isopropyl secondary-butyl dithiophosphate.

The phosphorus antiwear additive may also be a metal salt of (a) at least one dithiophosphoric acid and (b) at least one aliphatic or alicyclic carboxylic acid. The ditiophosphoric acids are described above. The carboxylic acid may be a monocarboxylic or polycarboxylic acid, usually containing from 1 to about 3, or just one carboxylic acid group. The preferred carboxylic acids are those having the formula R'COOH, wherein R' is an aliphatic or alicyclic hydrocarbyl group preferably free from acetylenic unsaturation. R' generally contains from about 2, or from about 4 carbon atoms. R' generally contains up to about 40, or up to about 24, or to up about 12 carbon atoms. In one embodiment, R' contains from 4, or from about 6 up to about 12, or up to about 8 carbon atoms. In one embodiment, R' is an alkyl group. Suitable acids include the butanoic, pentanoic, hexanoic, octanoic, nonanoic, decanoic, dodecanoic, octodecanoic, and eicosanoic acids, as well as olefinic acids such as oleic, linoleic, and linolenic acids and linoleic acid dimer.

The phosphorus antiwear additive may also be a phosphorus containing amide. The phosphorus containing amides are prepared by the reaction of one of the above described phosphorus acids, preferably a dithiophosphoric acid, with an unsaturated amide. Examples of unsaturated amides include acrylamide, N,N'-methylene bisacrylamide, methacrylamide, crotonamide, and the like. The reaction product of the phosphorus acid and the unsaturated amide may be further reacted with a linking or a coupling compound, such as formaldehyde or paraformaldehyde.

The phosphorus antiwear additive may also be a phosphorus containing carboxylic ester. The phosphorus containing carboxylic esters are prepared by reaction of one of the above-described phosphorus acids, preferably a dithiophosphoric acid, and an unsaturated carboxylic acid or ester. If the carboxylic acid is used, the ester may then be formed by subsequent reaction of the phosphoric acid-unsaturated carboxylic acid adduct with an alcohol, such as those described herein. In one embodiment, the alcohol has from 1 to about 12 carbon atoms. In one embodiment, the unsaturated carboxylic ester is a vinyl ester. The vinyl ester may be represented by the formula R"CH═CH—O(O)CR'", wherein R" is a hydrocarbyl group having from 1 to about 30, or to about 12 carbon atoms, preferably hydrogen, and R'" is a hydrocarbyl group having 1 to about 30, or to about 12, or to about 8 carbon atoms. Examples of vinyl esters include vinyl acetate, vinyl 2-ethylhexanoate, vinyl butanoate, and the like. Examples of unsaturated carboxylic esters include methyl acrylate, ethyl acrylate, 2-ethylhexyl acrylate, 2-hydroxyethyl acrylate, ethyl methacrylate, 2-hydroxyethyl methacrylate, 2-hydroxypropyl methacrylate, 2-hydroxypropyl acrylate, ethyl maleate, butyl maleate, and 2-ethylhexyl maleate.

Ashless Dialkyl Dithiophosphate:

In yet other approaches or embodiments, the phosphorus antiwear additive includes a phosphorus and sulfur providing antiwear additive in the form of an acidic thiophosphate or a thiophosphate ester. In this form, this phosphorus and sulfur providing additive may be an ashless, amine free dialkyl dithiophosphate acid ester or sulfur-containing phosphoric acid ester. In this approach, the ashless, amine free dialkyl dithiophosphate provides about 100 ppm or less phosphorus and about 150 ppm or less sulfur to the driveline lubricating compositions herein.

The acidic thiophosphate, the thiophosphate ester, or the sulfur-containing phosphoric acid esters providing sulfur and phosphorus to the lubricants herein may have one or more sulfur to phosphorus bonds. In an embodiment, the sulfur-containing phosphorus acid ester may be an acidic thiophosphate, a thiophosphate ester, a thiophosphorus acid or salt thereof. The thiophosphorus acid esters may be dithiophosphorus acid esters. In some more specific approaches, the acidic thiophosphate or thiophosphate ester may have a structure of Formula IV or a salt thereof (Formula IV)

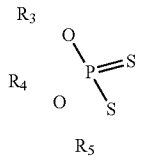

wherein $R_3$ and $R_4$ of Formula IV are each, independently, a linear or branched $C_1$ to $C_{10}$ hydrocarbyl group and $R_5$ of Formula IV is a $C_1$ to $C_{10}$ linear or branched carboxylic group or a $C_1$ to $C_{10}$ linear or branched alkyl alkanoate group. Preferably, $R_3$ and $R_4$ of Formula IV are each a $C_3$ to $C_8$ linear or branched alkyl group and $R_5$ of Formula IV is derived from 2-methyl proponoic acid such that the phosphorus product (or a salt thereof) has the structure of Formula V below:

(Formula V)

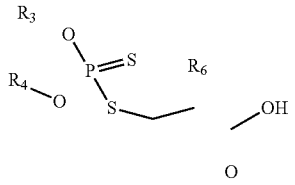

wherein $R_3$ and $R_4$ of Formula V above are, independently, a $C_3$ to $C_8$ linear or branched alkyl group (preferably, a branched $C_4$ group), and $R_6$ of Formula V above is —H or —$CH_3$. In some approaches or embodiments, the phosphorus additive is preferably 3-[[bis(2-methylpropoxy) phosphinothioyl]thio]-2-methyl-propanoic acid.

In some approaches, the phosphorus antiwear additive including the ashless dialkyl dithiophosphate is made by a process comprising the steps of (a) reacting an organic hydroxy compound with phosphorus pentasulfide (in some forms, a monomer or a dimer thereof) to form a reaction product and further reacting the reaction product with an unsaturated carboxylic acid to form the oil-soluble phosphorus antiwear additive including the ashless dialkyl dithiophosphate.

Suitable organic hydroxy compounds may include normal straight chain alcohols, branched chain alcohols, hydroxy aryl compounds, such as phenol and naphthol, substituted aryl hydroxy compounds, such as diamyl phenol, or any other hydroxy organic material in which the hydroxy group will react with the phosphorus pentasulfide, In one approach, the staring alcohols are saturated alcohols or substituted aryl hydroxy compounds such as aryl hydroxy compounds substituted by saturated alkyl radicals. In some approaches, the organic hydroxy compound may be a $C_1$ to $C_{10}$ (in other approaches, a $C_1$ to C6) linear or branched alcohols, a hydroxy aryl compound, or mixtures thereof such as one or more of methyl alcohol, ethyl alcohol, propyl alcohol, isopropyl alcohol, butyl alcohol, isobutyl alcohol, tert-butyl alcohol, sec-butyl alcohol, phenol, naphthol, an amyl alcohol, hexyl alcohol, iso-hexyl alcohol, octyl alcohol, decyl alcohol, dodecyl alcohol, octadecyl alcohol, 2-ethylhexyl alcohol, 4-methyl-2-pentyl alcohol, phenyl alcohol, butylphenyl alcohol, cyclohexyl alcohol, methylcyclopentyl alcohol, propenyl alcohol, butenyl alcohol, or combinations thereof. Preferred organic hydroxy compounds herein include $C_1$ to C4 alcohols such as ethyl alcohol, propyl alcohol, or isopropyl alcohol, and most preferably, the organic hydroxy compound is isobutyl alcohol.

Suitable unsaturated carboxylic acids to form the oil-soluble phosphorus antiwear additives of the present disclosure may include a wide variety of unsaturated carboxylic acids or fatty acids. Preferred unsaturated carboxylic acids may include $C_1$ to $C_{20}$ unsaturated fatty acids such as acrylic acid, methacrylic acid, 2-ethyl acrylic acid, or combinations thereof and, most preferably, is methacrylic acid. (As used herein, (meth)acrylic acid refers to either acrylic acid or methacrylic acid.)

In some embodiments, the phosphorus and sulfur providing antiwear additive is an acidic thiophosphate or a thiophosphate ester present in the compositions herein in an amount to provide no more than about 100 phosphorus and no more than about 150 ppm sulfur to the driveline lubricating oil compositions herein. In another embodiment, the phosphorus and sulfur providing antiwear additive is an acidic thiophosphate or a thiophosphate ester present in an amount to provide between 40 ppm and 100 ppm phosphorus and about 80 to about 150 ppm sulfur to the lubricating oil compositions. In one approach, the phosphorus and sulfur providing additive is an acidic thiophosphate or a thiophosphate ester present in an amount to provide between 50 ppm and 80 ppm phosphorus and about 100 to about 150 ppm sulfur to the lubricating oil compositions.

Driveline Lubricating Compositions

In yet other approaches, the driveline lubricating oil compositions herein balance the amount of total sulfur and total phosphorus provided by other additives (e.g., such as the phosphorus antiwear additives, the ashless dialkyl dithiophosphate antiwear additive, or others, as discussed above and/or other sulfur and phosphorus additives) relative to the amount of molybdenum from the oil-soluble organomolybdenum compound or complex (which, as discussed above, is substantially free of sulfur and/or phosphorus). In one approach, the lubricating oil compositions herein include additives providing up to about 300 ppm of total sulfur (in other approaches, up to about 200 ppm of total sulfur, or up to about 150 ppm of total sulfur) and additives providing up to about 200 ppm or total phosphorus (in other approaches, up to about 175 ppm of total phosphorus, or up to about 150 ppm of total phosphorus). In some embodiments, as shown in the Examples below, the driveline lubricating oil compositions herein also balance total sulfur and total phosphorus relative to total molybdenum (e.g., (S+P)/Mo) in a weight ratio of about 0.7 to about 10.0 (in other approaches, about 0.7 to about 9.9, or about 1.0 to about 9.8, or about 1.9 to about 9.8 or any other ranges therewithin).

Base Oil:

The driveline lubricating compositions herein include one or more base oils having a lubricating viscosity. Base oils suitable for use in formulating the driveline lubricating compositions for use in electric and/or hybrid-electric motor vehicles according to the disclosure may be selected from any of suitable synthetic or natural oils or mixtures thereof having a suitable lubricating viscosity. Natural oils may include animal oils and vegetable oils (e.g., castor oil, lard oil) as well as mineral oils such as liquid petroleum oils and solvent treated or acid-treated mineral lubricating oils of the paraffinic, naphthenic or mixed paraffinic-naphthenic types. Oils derived from coal or shale may also be suitable. Further, oil derived from a gas-to-liquid process is also suitable. The base oil may have a kinematic viscosity at 100° C. of about 2 to about 15 cSt, as measured by ASTM D2270-10.

The base oil as used in the driveline lubricating compositions described herein may be a single base oil or may be a mixture of two or more base oils selected from API Groups I to V. In one embodiment, the one or more base oil(s) may be selected from any of the base oils in Groups III and/or IV as specified in the American Petroleum Institute (API) Base Oil Interchangeability Guidelines. Such base oil groups are shown in Table 1 as follows:

TABLE 1

| Base oil Category | Sulfur (%) | | Saturates (%) | Viscosity Index |
|---|---|---|---|---|
| API Group I | >0.03 | and/or | <90 | 80 to 120 |
| API Group II | ≤0.03 | and | ≥90 | 80 to 120 |
| API Group III | ≤0.03 | and | ≥90 | ≥120 |
| API Group IV | All polyalphaolefins (PAOs) | | | |
| API Group V | All others not included in Groups I, II, III, or IV | | | |

API Group III base oils may include oil derived from Fischer-Tropsch synthesized hydrocarbons. Fischer-Tropsch synthesized hydrocarbons are made from synthesis gas containing $H_2$ and CO using a Fischer-Tropsch catalyst. Such hydrocarbons typically require further processing in order to be useful as the base oil. These types of oils are commonly referred to as gas-to-liquids (GTLs). For example, the hydrocarbons may be hydroisomerized using processes disclosed in U.S. Pat. No. 6,103,099 or 6,180,575; hydrocracked and hydroisomerized using processes disclosed in U.S. Pat. No. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

API Group IV base oils, PAOs, are typically derived from monomers having from 4 to 30, or from 4 to 20, or from 6 to 16 carbon atoms. Examples of PAOs that may be used in the present invention include those derived from octene, decene, mixtures thereof, and the like. PAOs may have a kinematic viscosity of from 2 to 15, or from 3 to 12, or from 4 to 8 cSt at 100° C., as measured by ASTM D2270-10. Examples of PAOs include 4 cSt at 100° C. PAOs, 6 cSt at 100° C. PAOs, and mixtures thereof.

The base oil(s) are combined with an additive composition as disclosed in embodiments herein to provide a driveline lubricating composition for use in an electric motor system having an electric motor, gears, and clutches. Accordingly, the base oil may be present in the driveline lubricating composition in an amount greater than about 80 wt % based on the total weight of the lubricating composition. In some embodiments, the base oil may be present in the driveline lubricating composition in an amount greater than about 85 wt % based on the total weight of the driveline lubricating composition.

Other Additives

The driveline lubricating compositions described herein may also include other additives of the type used in transmission fluid compositions in addition to the components described above. Such additives include, but are not limited to, antioxidant(s), viscosity modifier(s), phosphorus-containing components, detergent(s), antirust additives, antifoam agent(s), demulsifier(s), pour point depressant(s), seal swell agent(s), dispersant(s), and/or sulfur-containing component(s) as needed for a particular application.

ANTIOXIDANTS: In some embodiments, the driveline lubricating compositions contains one or more antioxidants. Suitable antioxidants include phenolic antioxidants, aromatic amine antioxidants, sulfur containing antioxidants, and organic phosphites, among others.

Examples of phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-ter-t-butylphenol), and mixed methylene-bridged polyalkyl phenols, and 4,4'-thiobis(2-methyl-6-tert-butylphenol), N,N'-di-sec-butyl-phenylenediamine, 4-iisopropylaminodiphenylamine, phenyl-alpha-naphthyl amine, phenyl-alpha-naphthyl amine, and ring-alkylated diphenylamines. Examples include the sterically hindered tertiary butylated phenols, bisphenols and cinnamic acid derivatives and combinations thereof.

Aromatic amine antioxidants include, but are not limited to diarylamines having the formula:

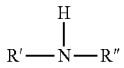

wherein R' and R" each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

Examples of diarylamines that may be used include, but are not limited to: diphenylamine; various alkylated diphenylamines, 3-hydroxydiphenylamine, N-phenyl-1,2-phenylenediamine, N-phenyl-1,4-phenylenediamine, monobutyldiphenyl-amine, dibutyldiphenylamine, monooctyldiphenylamine, dioctyldiphenylamine, monononyldiphenylamine, dinonyldiphenylamine, monotetradecyldiphenylamine, ditetradecyldiphenylamine, phenyl-alpha-naphthylamine, monooctyl phenyl-alpha-naphthylamine, phenyl-beta-naphthylamine, monoheptyldiphenylamine, diheptyl-diphenylamine, p-oriented styrenated diphenylamine, mixed butyloctyldi-phenylamine, and mixed octyl-styryldiphenylamine.

The sulfur containing antioxidants include, but are not limited to, sulfurized olefins that are characterized by the type of olefin used in their production and the final sulfur content of the antioxidant. High molecular weight olefins, i.e., those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The total amount of antioxidant in the lubricating compositions described herein may be present in an amount to deliver up to about 200 ppm nitrogen, or up to about 150 ppm nitrogen, or about 100 to about 150 ppm nitrogen.

DETERGENTS: Metal detergents that may be included in the driveline lubricating compositions described herein may generally comprise a polar head with a long hydrophobic tail where the polar head comprises a metal salt of an acidic organic compound. The salts may contain a substantially stoichiometric amount of the metal, in which case they are usually described as normal or neutral salts, and would typically have a total base number or TBN (as measured by ASTM D2896) of from 0 to less than 150. Large amounts of a metal base may be included by reacting an excess of a metal compound such as an oxide or hydroxide with an acidic gas such as carbon dioxide. The resulting overbased detergent comprises micelles of neutralized detergent surrounding a core of inorganic metal base (e.g., hydrated carbonates). Such overbased detergents may have a TBN of 150 or greater, such as from 150 to 450 or more.

Detergents that may be suitable for use in the present embodiments include oil-soluble overbased, low base, and neutral sulfonates, phenates, sulfurized phenates, and salicylates of a metal, particularly the alkali or alkaline earth metals, e.g., sodium, potassium, lithium, calcium, and magnesium. More than one metal may be present, for example, both calcium and magnesium. Mixtures of calcium and/or magnesium with sodium may also be suitable. Suitable metal detergents may be overbased calcium or magnesium sulfonates having a TBN of from 150 to 450 TBN, overbased calcium or magnesium phenates or sulfurized phenates having a TBN of from 150 to 300 TBN, and overbased calcium or magnesium salicylates having a TBN of from 130 to 350. Mixtures of such salts may also be used.

The metal-containing detergent may be present in the fluid in an amount sufficient to provide up to 500 ppm alkali and/or alkaline earth metal based on a total weight of the lubricating composition. In one example, the metal-containing detergent may be present in an amount sufficient to provide about 50 to about 500 ppm alkali and/or alkaline earth metal. In another embodiment, the metal-containing detergent may be present in an amount sufficient to provide from about 100 to about 400 ppm alkali and/or alkaline earth metal. In one approach, preferred detergents may be neutral, low-based, or overbased sulfonates, and in some approaches, overbased calcium sulfonates. Suitable detergents may be calcium sulfonates having a TBN of 250 or more (such as about 250 to about 450 or 280 to 400) and providing more than about 50 ppm of calcium to the lubricant. In other approaches, the detergents may provide about 50 to about 500 ppm of calcium, about 100 to about 400 ppm of calcium, or about 100 to about 300 ppm of calcium, or about 100 to about 200 ppm calcium to the lubricating compositions herein.

DISPERSANTS: The lubricating composition may include one or more select dispersants or mixtures thereof. Dispersants are often known as ashless-type dispersants because, prior to mixing in a lubricating oil composition, they do not contain ash-forming metals and they do not normally contribute any ash when added to a lubricant. Ashless-type dispersants are characterized by a polar group attached to a relatively high molecular or weight hydrocarbon chain. Typical ashless dispersants include N-substituted long chain alkenyl succinimides. N-substituted long chain alkenyl succinimides include polyisobutylene (PIB) substituents with a number average molecular weight of the polyisobutylene substituent in a range of about 800 to about 2500 as determined by gel permeation chromatograph (GPC) using polystyrene (with a number average molecular weight of 180 to about 18,000) as the calibration reference. The PIB substituent used in the dispersant typically has a viscosity at 100° C. of about 2100 to about 2700 cSt as determined using ASTM D445-18. Succinimide dispersants and their preparation are disclosed, for instance in U.S. Pat. Nos. 7,897,696 and 4,234,435 which are incorporated herein by reference. Succinimide dispersants are typically an imide formed from a polyamine, typically a poly(ethyleneamine). The dispersants may include two succinimide moieties joined by a polyamine. The polyamine may be tetra ethylene penta amine (TEPA), tri ethylene tetra amine (TETA), penta ethylene hexa amine (PEHA), other higher nitrogen ethylene diamine species and/or mixtures thereof. The polyamines may be mixtures of linear, branched and cyclic amines. The PIB substituents may be joined to each succinimide moiety.

In some embodiments the lubricant composition comprises at least one polyisobutylene succinimide dispersant derived from polyisobutylene with number average molecular weight in the range about 350 to about 5000, or about 500 to about 3000, as measured by the GPC method described above. The polyisobutylene succinimide may be used alone or in combination with other dispersants.

In some embodiments, polyisobutylene (PIB), when included, may have greater than 50 mol. %, greater than 60 mol. %, greater than 70 mol. %, greater than 80 mol. %, or greater than 90 mol. % content of terminal double bonds. Such a PIB is also referred to as highly reactive PIB ("HR-PIB"). HR-PIB having a number average molecular weight ranging from about 800 to about 5000 is suitable for use in embodiments of the present disclosure. Conventional non-highly reactive PIB typically has less than 50 mol. %, less than 40 mol. %, less than 30 mol. %, less than 20 mol. %, or less than 10 mol. % content of terminal double bonds.

An HR-PIB having a number average molecular weight ranging from about 900 to about 3000, as measured by the GPC method described above, may be suitable. Such an HR-PIB is commercially available, or can be synthesized by the polymerization of isobutene in the presence of a non-chlorinated catalyst such as boron trifluoride, as described in U.S. Pat. Nos. 4,152,499 and 5,739,355. When used in the aforementioned thermal ene reaction, HR-PIB may lead to higher conversion rates in the reaction, as well as lower amounts of sediment formation, due to increased reactivity.

In some embodiments the lubricant composition comprises at least one dispersant derived from polyisobutylene succinic anhydride. In an embodiment, the dispersant may be derived from a polyalphaolefin (PAO) succinic anhydride. In an embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides.

The dispersants may also be post-treated by conventional methods by reaction with any of a variety of agents. Among these agents are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 describes some suitable post-treatment methods and post-treated products.

Suitable boron compounds useful in forming the dispersants herein include any boron compound or mixtures of boron compounds capable of introducing boron-containing species into the ashless dispersant. Any boron compound, organic or inorganic, capable of undergoing such reaction can be used. Accordingly, use can be made of boron oxide, boron oxide hydrate, boron trifluoride, boron tribromide, boron trichloride, $HBF_4$ boron acids such as boronic acid (e.g. alkyl-$B(OH)_2$ or aryl-$B(OH)_2$), boric acid, (i.e., $H_3BO_3$), tetraboric acid (i.e., $H_2B_5O_7$), metaboric acid (i.e., $HBO_2$), ammonium salts of such boron acids, and esters of such boron acids. The use of complexes of a boron trihalide with ethers, organic acids, inorganic acids, or hydrocarbons is a convenient means of introducing the boron reactant into the reaction mixture. Such complexes are known and are exemplified by boron trifluoride-diethyl ether, boron trifluoride-phenol, boron trifluoride-phosphoric acid, boron trichloride-chloroacetic acid, boron tribromide-dioxane, and boron trifluoride-methyl ethyl ether.

Suitable phosphorus compounds for forming the dispersants herein include phosphorus compounds or mixtures of phosphorus compounds capable of introducing a phosphorus-containing species into the ashless dispersant. Any phosphorus compound, organic or inorganic, capable of undergoing such reaction can thus be used. Accordingly, use can be made of such inorganic phosphorus compounds as the inorganic phosphorus acids, and the inorganic phosphorus oxides, including their hydrates. Typical organic phosphorus compounds include full and partial esters of phosphorus acids, such as the mono-, di-, and tri esters of phosphoric acid, thiophosphoric acid, dithiophosphoric acid, trithiophosphoric acid and tetrathiophosphoric acid; the mono-, di-, and tri esters of phosphorous acid, thiophosphorous acid, dithiophosphorous acid and trithiophosphorous acid; the trihydrocarbyl phosphine oxides: the trihydrocarbyl phosphine sulfides; the mono- and dihydrocarbyl phosphonates, (RPO(OR')(OR") where R and R' are hydrocarbyl and R" is a hydrogen atom or a hydrocarbyl group), and their mono-, di- and trithio analogs; the mono- and dihydrocarbyl phosphonites, (RP(OR')(OR") where R and R' are hydrocarbyl and R" is a hydrogen atom or a hydrocarbyl group) and their mono- and dithio analogs; and the like. Thus, use can be made of such compounds as, for example, phosphorous acid ($H_3PO_3$, sometimes depicted as $H_2(HPO_3)$, and sometimes called ortho-phosphorous acid or phosphonic acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_5P_4O_{13}$), trimetaphosphoric acid ($H_3P_3O_9$), phosphorus trioxide, phosphorus tetraoxide, phosphorus pentoxide, and the like. Partial or total sulfur analogs such as phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), phosphorus sesquisulfide, phosphorus heptasulfide, and phosphorus pentasulfide ($P_2S_5$, sometimes referred to as $P_4$Sio) can also be used in forming dispersants for this disclosure. Also usable are the inorganic phosphorus halide compounds such as $PCl_3$, $PBr_3$, $POCl_3$, $PSCl_3$, etc.

Likewise use can be made of such organic phosphorus compounds as mono-, di-, and triesters of phosphoric acid (e.g., trihydrocarbyl phosphates, dihydrocarbyl monoacid phosphates, monohydrocarbyl diacid phosphates, and mixtures thereof), mono-, di-, and triesters of phosphorous acid (e.g., trihydrocarbyl phosphites, dihydrocarbyl hydrogen phosphites, hydrocarbyl diacid phosphites, and mixtures thereof), esters of phosphonic acids (both "primary", $RP(O)(OR)_2$, and "secondary", $R_2P(O)(OR)$), esters of phosphinic acids, phosphonyl halides (e.g., $RP(O)Cl_2$ and $R_2P(O)Cl$), halophosphites (e.g., $(RO)PCl_2$ and $(RO)_2PCl$), halophosphates (e.g., $ROP(O)Cl_2$ and $(RO)_2P(O)Cl$), tertiary pyrophosphate esters (e.g., $(RO)_2P(O)—O—P(O)(OR)_2$), and the total or partial sulfur analogs of any of the foregoing organic phosphorus compounds, and the like wherein each hydrocarbyl group contains up to about 100 carbon atoms, or up to about 50 carbon atoms, or up to about 24 carbon atoms, or up to about 12 carbon atoms. Also usable are the halophosphine halides (e.g., hydrocarbyl phosphorus tetrahalides, dihydrocarbyl phosphorus trihalides, and trihydrocarbyl phosphorus dihalides), and the halophosphines (monohalophosphines and dihalophosphines).

The lubricants herein may include mixtures of one or more boronated and phosphorylated dispersants set forth above combined with non-boronated and non-phosphorylated dispersants.

In one embodiment the lubricating oil composition may include at least one borated dispersant, wherein the dispersant is the reaction product of an olefin copolymer or a reaction product of an olefin copolymer with succinic anhydride, and at least one polyamine. The ratio of PIBSA: polyamine may be from 1:1 to 10:1, or 1:1 to 5:1, or 4:3 to 3:1, or 4:3 to 2:1. A particularly useful dispersant contains a polyisobutenyl group of the PIBSA having a number average molecular weight (Mn) in the range of from about 500 to 5000, as determined by the GPC method described above, and a (B) polyamine having a general formula $H_2N(CH_2)_m—[NH(CH_2)_m]_n—NH_2$, wherein m is in the range from 2 to 4 and n is in the range of from 1 to 2.

In addition to the above, the dispersant may be post-treated with an aromatic carboxylic acid, an aromatic polycarboxylic acid, or an aromatic anhydride wherein all carboxylic acid or anhydride group(s) are attached directly to an aromatic ring. Such carboxyl-containing aromatic compounds may be selected from 1,8-naphthalic acid or anhydride and 1,2-naphthalenedicarboxylic acid or anhydride, 2,3-naphthalenedicarboxylic acid or anhydride, naphthalene-1,4-dicarboxylic acid, naphthalene-2,6-dicarboxylic acid, phthalic anhydride, pyromellitic anhydride, 1,2,4-benzene tricarboxylic acid anhydride, diphenic acid or anhydride, 2,3-pyridine dicarboxylic acid or anhydride, 3,4-pyridine dicarboxylic acid or anhydride, 1,4,5,8-naphthalenetetracarboxylic acid or anhydride, perylene-3,4,9,10-tetracarboxylic anhydride, pyrene dicarboxylic acid or anhydride, and the like. The moles of this post-treatment component reacted per mole of the polyamine may range from about 0.1:1 to about 2:1. A typical molar ratio of this post-treatment component to polyamine in the reaction mixture may range from about 0.2:1 to about 2:1. Another molar ratio of this post-treatment component to the polyamine that may be used may range from 0.25:1 to about 1.5:1. This post-treatment component may be reacted with the other components at a temperature ranging from about 140° to about 180° C.

Alternatively, or in addition to the post-treatment described above, the dispersant may be post-treated with a non-aromatic dicarboxylic acid or anhydride. The non-aromatic dicarboxylic acid or anhydride of may have a number average molecular weight of less than 500, as measured by the GPC method described above. Suitable carboxylic acids or anhydrides thereof may include, but are not limited to acetic acid or anhydride, oxalic acid and anhydride, malonic acid and anhydride, succinic acid and anhydride, alkenyl succinic acid and anhydride, glutaric acid and anhydride, adipic acid and anhydride, pimelic acid and anhydride, suberic acid and anhydride, azelaic acid and anhydride, sebacic acid and anhydride, maleic acid and anhydride, fumaric acid and anhydride, tartaric acid and anhydride, glycolic acid and anhydride, 1,2,3,6-tetrahydronaphthalic acid and anhydride, and the like.

The non-aromatic carboxylic acid or anhydride is reacted at a molar ratio with the polyamine ranging from about 0.1 to about 2.5 moles per mole of polyamine. Typically, the amount of non-aromatic carboxylic acid or anhydride used will be relative to the number of secondary amino groups in the polyamine. Accordingly, from about 0.2 to about 2.0 moles of the non-aromatic carboxylic acid or anhydride per secondary amino group in Component B may be reacted with the other components to provide the dispersant according to embodiments of the disclosure. Another molar ratio of the non-aromatic carboxylic acid or anhydride to polyamine that may be used may range from 0.25:1 to about 1.5:1 moles of per mole of polyamine. The non-aromatic carboxylic acid or anhydride may be reacted with the other components at a temperature ranging from about 140° to about 180° C.

The weight % actives of the alkenyl or alkyl succinic anhydride can be determined using a chromatographic technique. This method is described in column 5 and 6 in U.S. Pat. No. 5,334,321. The percent conversion of the polyolefin is calculated from the % actives using the equation in column 5 and 6 in U.S. Pat. No. 5,334,321.

The TBN of a suitable borated dispersant may be from about 10 to about 65 mg KOH/gram composition on an oil-free basis, which is comparable to about 5 to about 30 mg KOH/gram composition TBN if measured on a dispersant sample containing about 50% diluent oil.

Typically, the dispersants described above are provided in about 1 to about 15 weight percent and, in other approaches, about 1.5 to about 8 weight percent, and in yet other approaches, about 2 to about 6 weight percent in the lubricant.

VISCOSITY MODIFIERS: The driveline lubricating compositions may optionally contain one or more viscosity modifiers. Suitable viscosity modifiers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity modifiers may include star polymers and suitable examples are described in US Publication No. 2012/0101017 A1.

The driveline lubricating compositions described herein also may optionally contain one or more dispersant viscosity modifiers in addition to a viscosity modifier or in lieu of a viscosity modifier. Suitable dispersant viscosity modifiers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity modifier and/or dispersant viscosity modifier, when present, may be up to about 2.0 wt %, or up to about 1.0 wt %, or up to about 0.5 wt %, or up to about 0.3 wt % based on the total weight of the lubricating compositions.

DEMULSIFIERS: Demulsifiers include trialkyl phosphates, and various polymers and copolymers of ethylene glycol, ethylene oxide, propylene oxide, or mixtures thereof, including polyethylene oxides, polypropylene oxides and (ethylene oxide-propylene oxide) polymers. When present, the amount of demulsifier in the lubricating compositions may be up about 0.05 wt, or up to about 0.02 wt %, or below about 0.015 wt % based on the total weight of the lubricating compositions.

ANTIFOAM AGENTS: Antifoam agents used to reduce or prevent the formation of stable foam include silicones, polyacrylates, or organic polymers. Foam inhibitors that may be useful in the compositions of the disclosed invention include polysiloxanes, copolymers of ethyl acrylate and 2-ethylhexylacrylate and optionally vinyl acetate. When present, the amount of antifoam in the lubricating compositions may be up about 0.1 wt, or up to about 0.05 wt %, or below about 0.04 wt % based on the total weight of the lubricating compositions.

In general terms, driveline lubricating compositions described herein may include additive components in the ranges listed in Table 2.

TABLE 2

| Component | Wt. % (Suitable Embodiments) | Wt. % (Preferred Embodiments) |
|---|---|---|
| Organomolybdenum Friction Modifier | 0.0-1.0 | 0.04-0.5 |
| Detergent(s) | 0.05-0.5 | 0.1-0.3 |
| Dispersant(s) | 1.0-15.0 | 2.0-6.0 |
| Sulfurized component(s) | 0.05-1.5 | 0.2-1.0 |
| Antiwear additive(s) | 0.01-1.5 | 0.05-0.5 |
| Antioxidant(s) | 0.1-0.6 | 0.3-0.5 |
| Antifoaming Agent(s) | 0.0-0.05 | 0.01-0.04 |
| Viscosity index improver(s) | 0.0-7.0 | 0.0-5.0 |
| Base oil | Balance | Balance |
| Total | 100 | 100 |

The percentages of each component above represent the weight percent of each component, based upon the total weight of the driveline lubricating compositions containing the recited component. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent). The use of an additive concentrate takes advantage of the mutual compatibility afforded by the combination of ingredients when in the form of an additive concentrate. Also, the use of a concentrate reduces blending time and lessens the possibility of blending errors.

The following definitions of terms are provided in order to clarify the meanings of certain terms as used herein.

The terms "lubricating oil," "lubricant composition," "lubricating composition," "lubricant" and "driveline lubricating composition" refer to a finished lubrication product comprising a major amount of a base oil plus a minor amount of an additive composition.

As used herein, the terms "additive package," "additive concentrate," and "additive composition," refer the portion of the lubricating oil composition excluding the major amount of base oil.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "percent by weight" or "wt %", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "alkyl" as employed herein refers to straight, branched, cyclic, and/or substituted saturated chain moieties from about 1 to about 200 carbon atoms.

The term "alkenyl" as employed herein refers to straight, branched, cyclic, and/or substituted unsaturated chain moieties from about 3 to about 30 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, and oxygen.

As used herein, the "average number molecular weight" or "Mn" is determined by gel permeation chromatography (GPC) using commercially available polystyrene standards (with a Mn of about 180 to about 18,000 as the calibration reference).

It is to be understood that throughout the present disclosure, the terms "comprises," "includes," "contains," etc. are considered open-ended and include any element, step, or ingredient not explicitly listed. The phrase "consists essentially of" is meant to include any expressly listed element, step, or ingredient and any additional elements, steps, or ingredients that do not materially affect the basic and novel aspects of the invention. The present disclosure also contemplates that any composition described using the terms, "comprises," "includes," "contains," is also to be interpreted as including a disclosure of the same composition "consisting essentially of" or "consisting of" the specifically listed components thereof.

EXAMPLES

A better understanding of the present disclosure and its many advantages may be clarified with the following example. The following example is illustrative and not limiting thereof in either scope or spirit. Those skilled in the art will readily understand that variations of the components, methods, steps, and devices described in these examples can be used. Unless noted otherwise or apparent from the context of discussion in the Example below and throughout this disclosure, claims, and Examples, all percentages, ratios, and parts noted in this disclosure are by weight. Any standardized test method noted in the Examples, disclosure, or claims, unless apparent from the context of its use, refers to the version of the test method publicly available at the time of the filing of the present disclosure.

As used herein, friction performance evaluated a boundary layer friction coefficient using a high frequency reciprocating rig (HFRR) obtained from PCS Instruments or the like, using test conditions as generally described in the SAE paper "Critical Oil Physical Properties that control the Fuel Economy Performance of General Motors Vehicles," SAE Technical Paper 982503, 1998 and as further described herein. As used herein, this friction coefficient test determines the friction coefficient of a lubricating composition between an SAE 52100 metal ball and an SAE 52100 metal disk. For this testing, the test samples are measured by submerging the contact between the SAE 52100 metal ball and the SAE 52100 metal disk in a temperature controlled bath of the lubricant being evaluated under a fixed load forwards and backwards at a set stroke frequency. The friction coefficients of the driveline lubricating compositions herein were evaluated at a temperature of about 130° C. and the friction coefficient and temperature were monitored throughout the test. The ability of the lubricant to reduce boundary layer friction is reflected by the determined boundary lubrication regime friction coefficients. A lower value is indicative of lower friction. For the evaluations, the ball was oscillated across the disk at a frequency of 20 Hz over a 1 mm path and with an applied load of 400 grams. Each sample was tested in the HFRR for 3 minutes and the data over the last 2 minutes was averaged to produce the friction coefficients.

Copper corrosion was evaluated using ASTM D130 at 150° C. for 168 hours. Results are provided in ppm of copper leaching and a visual copper tarnishing rating.

The Inventive formulations of this Example contained varying amounts of the discovered organomolybdenum friction modifier while Comparative formulations of this Example included other molybdenum friction modifiers, amine-based friction modifiers, and/or conventional tolyltriazole corrosion inhibitors. Each evaluated driveline lubricant also included the same base additive package (other than the friction modifier and corrosion inhibitor components as noted in Table 3) and contained the same dispersants, antiwear, antioxidants, antifoam agents, and viscosity modifiers. All lubricants evaluated included less than about 0.01 weight percent of methyl-1H-benzotriazole (some comparative lubricants added additional amounts of this compound as noted in the tables below.) The Inventive and Comparative formulations were tested in the same base oil blend of API Group III base oils with treat rates thereof to obtain finished fluids having a kV100° C. of approximately 3.7 cSt (ASTM D445). Components varied in the fluids of Table 3 below included the following:

- Phosphorus Antiwear Additive (P 1): an ashless dialkyl dithiophosphate including at least 3-[[bis(2-methylpropoxy) phosphinothioyl]thio]-2-methyl-propanoic acid having about 9.5% phosphorus and about 19.5% sulfur.
- OrganoMolybdenum Friction Modifier 1 (FM 1): a commercially available oil soluble organomolybdenum complex having ester and amide moieties and derived from a fatty derivative of diethanolamine and an oxygen-containing molybdenum compound with about 8 to about 12% molybdenum.
- OrganoMolybdenum Friction Modifier 2 (FM 2): molybdenum dithiocarbamate having about 10% molybdenum and about 10% sulfur.
- Amine-based Friction Modifier 3 (FM 3): Fatty polyamine.
- Corrosion Inhibitor (CI 1): additional methyl-1H-benzotriazole As shown in the Tables below, all Inventive examples exhibited an improved friction coefficient and improved copper leaching protection relative to a baseline composition (BL). The baseline composition did not have either a friction modifier or additional corrosion inhibitor. Comparative lubricants included alternate friction modifiers or additional corrosion inhibitor and exhibited worse friction performance and/or copper leaching compared to the baseline composition (BL).

TABLE 3

| Driveline Lubricating Compositions | | | | | | | | | |
|---|---|---|---|---|---|---|---|---|---|
| | BL | Inv 1 | Inv 2 | Inv 3 | Comp 1 | Comp 2 | Comp 3 | Comp 4 | Comp 5 |
| P-1 (wt %) | 0.06 | 0.06 | 0.06 | 0.06 | 0.06 | 0.06 | 0.06 | 0.06 | 0.06 |
| FM-1 (wt %) | — | 0.04 | 0.2 | 0.5 | — | — | — | — | — |
| FM-2 (wt %) | — | — | — | — | 0.05 | — | — | — | — |
| FM-3 (wt %) | — | — | — | — | — | 0.04 | 0.2 | 0.5 | — |
| CI-1 (wt %) | — | — | — | — | — | — | — | — | 0.04 |

TABLE 4

| Elemental Analysis of Fluids | | | | | | | | | |
|---|---|---|---|---|---|---|---|---|---|
| | BL | Inv 1 | Inv 2 | Inv 3 | Comp 1 | Comp 2 | Comp 3 | Comp 4 | Comp 5 |
| Total phosphorus, ppm | 133 | 133 | 133 | 133 | 133 | 133 | 133 | 133 | 133 |
| Total Sulfur, ppm | 174 | 174 | 174 | 174 | 229 | 174 | 174 | 174 | 174 |
| Total Molybdenum, ppm | — | 31.6 | 158 | 395 | 51.8 | — | — | — | — |
| (S + P)/Mo | — | 9.7 | 1.9 | 0.77 | 7.1 | — | — | — | — |

TABLE 5

| Fluid Performance | | | | | | | | | |
|---|---|---|---|---|---|---|---|---|---|
| | BL | Inv 1 | Inv 2 | Inv 3 | Comp 1 | Comp 2 | Comp 3 | Comp 4 | Comp 5 |
| D130 Copper leaching (150° C., 168 hours), Cu ppm | 144 | 117 | 61 | 64 | 121 | 206 | 326 | 347 | 43 |
| D130 Copper tarnishing rating (150° C., 168 hours) | 2B | 2B | 2A | 2B | 3A | 4A | 4A | 4A | 2A |
| HERR friction coefficient, 130° C. | 0.155 | 0.146 | 0.115 | 0.056 | 0.145 | 0.132 | 0.127 | 0.080 | 0.160 |
| HERR Friction Reduction vs Baseline | — | 6% | 26% | 64% | 7% | 15% | 18% | 49% | −3% |

While Comparative samples 1 to 4 had good friction performance, copper corrosion performance was worse than the Inventive samples and/or significantly worse than the baseline fluid. Comparative sample 5 with an added corrosion inhibitor had good copper corrosion performance, but the friction coefficient was worse than the baseline. Only the Inventive samples had improved friction performance and low copper corrosion without the need for supplemental friction modifiers and/or corrosion inhibitors.

It is to be understood that while the lubricating composition and compositions of this disclosure have been described in conjunction with the detailed description thereof and summary herein, the foregoing description is intended to illustrate and not limit the scope of the disclosure, which is defined by the scope of the appended claims. Other aspects, advantages, and modifications are within the scope of the claims. It is intended that the specification and examples be considered as exemplary only, with a true scope of the disclosure being indicated by the following claims.

Other embodiments of the present disclosure will be apparent to those skilled in the art from consideration of the specification and practice of the embodiments disclosed herein. As used throughout the specification and claims, "a" and/or "an" may refer to one or more than one. Unless otherwise indicated, all numbers expressing quantities of ingredients, properties such as molecular weight, percent, ratio, reaction conditions, and so forth used in the specification are to be understood as being modified in all instances by the term "about," whether or not the term "about" is present. Accordingly, unless indicated to the contrary, the numerical parameters set forth in the specification are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, a range of from 1 to 4 is to be interpreted as an express disclosure of the values 1, 2, 3 and 4 as well as any range of such values such as 1 to 4, 1 to 3, 1 to 2, 2 to 4, 2 to 3 and so forth.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

What is claimed is:

1. A method of lubricating a driveline of an electric or hybrid-electric vehicle, the method comprising:

lubricating the driveline of the electric or hybrid-electric vehicle with a lubricating composition; and wherein the lubricating composition includes (i) one or more base oils of lubricating viscosity; (ii) a phosphorus antiwear additive providing about 100 ppm or less phosphorus to the driveline lubricating composition; (iii) a multi-functional oil-soluble organomolybdenum friction modifier and corrosion inhibitor having one or more ester and/or amide moieties and having about 1 to about 15 weight percent molybdenum; and wherein the driveline lubricating composition has less than about 300 ppm of total sulfur.

2. The method of claim 1, wherein the phosphorus antiwear additive includes an ashless dialkyl dithiophosphate antiwear additive providing about 100 ppm or less phosphorus and about 150 ppm or less sulfur to the driveline lubricating composition.

3. The method of claim 2, wherein the ashless dialkyl dithiophosphate is made by a process comprising the steps of reacting an organic hydroxy compound with phosphorus pentasulfide to form a reaction product and further reacting the reaction product with an unsaturated carboxylic acid to form the oil-soluble phosphorus antiwear additive including the ashless dialkyl dithiophosphate.

4. The method of claim 3, wherein the ashless dialkyl dithiophosphate includes a compound of Formula V, or a salt thereof:

(Formula V)

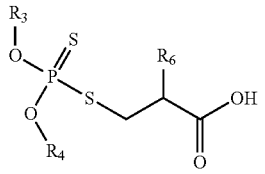

wherein $R_3$ and $R_4$ are, independently, a $C_3$ to $C_8$ linear or branched alkyl group, and $R_6$ is —H or —$CH_3$.

5. The method of claim 1, wherein the multi-functional oil-soluble organomolybdenum friction modifier and corrosion inhibitor provides about 20 to about 500 ppm molybdenum.

6. The method of claim 1, wherein the multi-functional oil-soluble organomolybdenum friction modifier and corrosion inhibitor having ester and/or amide ligands is substantially free of sulfur and/or phosphorus.

7. The method of claim 2, wherein the multi-functional oil-soluble organomolybdenum friction modifier and corrosion inhibitor having ester and/or amide ligands is substantially free of sulfur and/or phosphorus.

8. The method of claim 7, wherein the multi-functional oil-soluble organomolybdenum friction modifier and corrosion inhibitor having ester and/or amide ligands is derived from a fatty derivative of a dialkanolamine and a molybdenum source.

9. The method of claim 8, wherein the fatty derivative of the dialkanolamine is a fatty deriviative of diethanolamine and the molybdenum source is an oxygen-containing molybdenum compound.

10. The method of claim 9, wherein the oxygen-containing molybdenum compound is selected from an ammonium molybdate, a molybdenum oxide, or mixtures thereof.

11. The method of claim 1, wherein the multi-functional oil-soluble organomolybdenum friction modifier and corrosion inhibitor having one or more ester and/or amide moieties is the reaction product of about 1 mol of a fatty oil or fatty acid having 12 or more carbon atoms, about 1 to 2.5 mols of diethanolamine, and a source of molybdenum sufficient to yield about 1 to about 15 weight percent of molybdenum based on the weight of additive.

12. The method of claim 1, wherein a weight ratio of total sulfur and total phosphorus relative to total molybdenum (S+P)/Mo is about 0.7 to about 10.0.

13. The method of claim 1, wherein the driveline lubricating composition is substantially free of separate corrosion inhibitors and/or substantially free of separate friction modifiers.

14. The method of claim 13, wherein the separate corrosion inhibitors include monocarboxylic acid and/or polycarbocylic acid corrosion inhibitors, alkenyl succinic acid, acid/ester, or anhydride corrosion inhibitors, ether amine corrosion inhibitors, imidazoline corrosion inhibitors, benzotriazole corrosion inhibitors, or combinations thereof.

15. The method of claim 1, wherein the driveline lubricating composition has less than 120 ppm of copper leaching when evaluated pursuant to ASTM D130 at 150° C. after 168 hours.

16. The method of claim 15, wherein the driveline lubricating composition has a friction coefficient, when measured using a high frequency reciprocating rig (HFRR), of less than 0.160 and when evaluated using a 400 gram load, a 20 Hz frequency, and at a composition temperature of 130° C. for 3 minutes.

* * * * *